US008038392B2

(12) United States Patent
Honda et al.

(10) Patent No.: US 8,038,392 B2
(45) Date of Patent: Oct. 18, 2011

(54) AXIAL DIFFUSER FOR A CENTRIFUGAL COMPRESSOR

(75) Inventors: Shuichi Honda, Wako (JP); Mineyasu Oana, Wako (JP); Hidehiko Nakata, Wako (JP); Naoki Kuno, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 739 days.

(21) Appl. No.: 12/219,329

(22) Filed: Jul. 18, 2008

(65) Prior Publication Data

US 2009/0022586 A1 Jan. 22, 2009

(30) Foreign Application Priority Data

Jul. 18, 2007 (JP) ..... 2007-187419
Jul. 14, 2008 (JP) ..... 2008-182605

(51) Int. Cl.
*F01D 11/00* (2006.01)

(52) U.S. Cl. ..... 415/208.3; 415/211.1; 415/224.5

(58) Field of Classification Search .... 415/208.2–208.4, 415/211.1, 211.2, 224.5
See application file for complete search history.

(56) References Cited

U.S. PATENT DOCUMENTS

| | | | | |
|---|---|---|---|---|
| 3,837,762 | A * | 9/1974 | Lee | 415/207 |
| 5,944,482 | A * | 8/1999 | Cronin | 415/111 |
| 6,280,139 | B1 | 8/2001 | Romani et al. | |
| 6,537,028 | B1 | 3/2003 | Izumi et al. | |
| 2005/0042087 | A1 * | 2/2005 | Hamer et al. | 415/211.2 |
| 2009/0304502 | A1 * | 12/2009 | Nolcheff | 415/208.2 |
| 2010/0158722 | A1 * | 6/2010 | Sumser et al. | 417/423.1 |

FOREIGN PATENT DOCUMENTS

| | | |
|---|---|---|
| JP | 2002-098093 | 4/2002 |
| JP | 2002535553 A | 10/2002 |

* cited by examiner

*Primary Examiner* — Gary F. Paumen
(74) *Attorney, Agent, or Firm* — Squire, Sanders & Dempsey (US) LLP

(57) ABSTRACT

The effective efficiency of a centrifugal compressor can be improved by achieving a uniform distribution of fluid velocity across the outlet end of a fluid passage of an axial diffuser for the centrifugal compressor and a high static pressure recovery ratio Cp in the axial diffuser passage. The cross section of each axial diffuser passage is configured such that a relatively high velocity fluid flow in an upstream part of the diffuser passage is directed toward a negative pressure side of a cross section thereof. It can be accomplished by directing a minor axis of a cross section of the diffuser passage substantially perpendicularly to a direction directed from a center of the cross section of the diffuser passage to the central axial line of an impeller or directing the minor axis toward the central axial line of the impeller.

6 Claims, 10 Drawing Sheets

AXIAL DIFFUSER FOR A CENTRIFUGAL COMPRESSOR

TECHNICAL FIELD

The present invention relates to an axial diffuser for a centrifugal compressor, and in particular to an axial diffuser for a centrifugal compressor of a gas turbine engine or a jet engine.

BACKGROUND OF THE INVENTION

The centrifugal compressor used in a gas turbine engine or a jet engine typically includes an axial diffuser. In an axial diffuser, a plurality of axial diffuser passages are provided around the impeller at a regular circumferential interval, and as the radial flow of the fluid (compressed air) expelled from the impeller flows through each of the axial diffuser passages, the fluid flow is directed into an axial flow which is substantially in parallel with the central axial line of the impeller, and the kinetic energy of the fluid flow is converted into pressure energy. See U.S. Pat. No. 6,280,139, for instance.

Also is known the radial diffuser which is used in a centrifugal compressor to convert the kinetic energy of the fluid expelled from the impeller into pressure energy by reducing the velocity of the fluid in the radial flow. See Japanese patent laid open publication No. 2002-98093, for instance.

Each diffuser passage of an axial diffuser may consist of a tube member. If the tube member is straight, there is no centrifugal force, and, consequently, there is no unevenness in the fluid flow. However, in reality, because each diffuser tube is highly curved so as to direct the direction of the fluid flow from the tangential direction of the impeller into the axial direction, a centrifugal force is produced, and some pressure gradient (in the cross section of the diffuser tube) is produced in the fluid flowing in the diffuser tube.

In the case of the conventional axial diffuser using diffuser passages each having an elliptic cross section, no consideration was made to balance the centrifugal force along the major axis of the elliptic cross section of each diffuser passage. For this reason, a pressure unevenness or gradient in the cross section is produced from the first bend of each diffuser passage. In particular, a low velocity region (low momentum flow at the boundary layer) builds up on the negative pressure side of the diffuser passage so that the fluid velocity tends to be lower on the negative pressure side of the downstream end of the diffuser passage. Conversely, the fluid velocity is higher on the positive pressure side of the downstream end of the diffuser passage. Therefore, a significant pressure gradient is produced between the positive pressure side and negative pressure side at the downstream end of the diffuser passage.

Furthermore, in the negative pressure side, owing to a centrifugal force (inertia force) produced in the bend of the passage, a part of the fluid flow may separate from the wall surface, and this may create vortices. As a result, a part of the kinetic energy of the fluid flow is dissipated as heat, and the vortices diminish the effective cross sectional area of the fluid passage by blocking the fluid flow. For these reasons, the fluid velocity may not be reduced as designed. Therefore, in a conventional axial diffuser, the static pressure recovery ratio Cp=(static pressure at diffuser outlet−static pressure at diffuser inlet)/(total pressure at diffuser inlet−static pressure at diffuser inlet) is not so high as desired, and this prevented the effective efficiency of a centrifugal compressor to be increased to a desired level.

BRIEF SUMMARY OF THE INVENTION

In view of such problems of the prior art, a primary object of the present invention is to provide an axial diffuser for a centrifugal compressor that can improve the effective efficiency of the centrifugal compressor.

A second object of the present invention is to provide an axial diffuser for a centrifugal compressor that can avoid the separation of fluid flow on the negative side of the fluid passage.

A third object of the present invention is to provide an axial diffuser for a centrifugal compressor that can achieve a uniform distribution of fluid velocity across the outlet end of the fluid passage.

A fourth object of the present invention is to provide an axial diffuser for a centrifugal compressor that can achieve a high static pressure recovery ratio Cp.

According to the present invention, at least some of such objects can be accomplished by providing an axial diffuser for a centrifugal compressor, comprising a plurality of axial diffuser passages arranged around an impeller of the centrifugal compressor at a prescribed circumferential interval so that a radial fluid flow from the impeller is directed into an axial fluid flow substantially in parallel with a central axial line of the impeller, and kinetic energy of the fluid flow entering each diffuser passage is converted into pressure energy, wherein: each axial diffuser passage includes an upstream end communicating with an outlet part of the impeller and a downstream end extending substantially in parallel with an axial line of the impeller, and defines a cross section progressively increasing in area from the upstream end to the downstream end thereof, the cross section of each axial diffuser passage being configured such that a relatively high velocity fluid flow in an upstream part of the diffuser passage is directed toward a negative pressure side of a cross section thereof.

Thereby, the fluid velocity can be made uniform across the cross section of each diffuser passage, from the positive pressure side to the negative pressure side, and from the upstream end to the downstream end thereof, and can be made highly uniform across the cross section of the axial diffuser passage at the downstream end thereof. This contributes to the improvement in the efficiency of the centrifugal compressor. Preferably, the cross section of each axial diffuser passage is substantially elliptic or track shaped, and each axial diffuser passage is defined by an individual tube member. Typically, the upstream end of each axial diffuser passage extends tangentially from a peripheral part of the impeller.

According to a preferred embodiment of the present invention, the cross section of each axial diffuser passage has a minor axis and a major axis, and the minor axis extends substantially perpendicularly to a direction directed from a center of the cross section to the central axial line of the impeller. Alternatively, the minor axis and major axis may extend substantially perpendicularly to each other while the minor axis is directed toward the central axial line of the impeller. Thereby, the negative pressure side and positive pressure side of each cross section of the axial diffuser passage can be kept at a same distance from the central axial line of the centrifugal compressor.

Thus, the pressure gradient in each cross section of the axial diffuser passage owing to a centrifugal force can be minimized, and the unevenness in the flow of the compressed air in the axial diffuser passage can be minimized. In particular, the accumulation of uneven, low velocity air flow on the negative pressure side can be avoided. Also, the reduction in the unevenness of pressure which is otherwise created in each cross section owing to a centrifugal force contributes to the prevention of flow separation on the negative pressure side. The uniform distribution of fluid flow velocity at the outlet end of each axial diffuser passage, combined with the prevention of flow separation, increases the static pressure recovery ratio Cp, and improves the effective efficiency of the centrifugal compressor.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
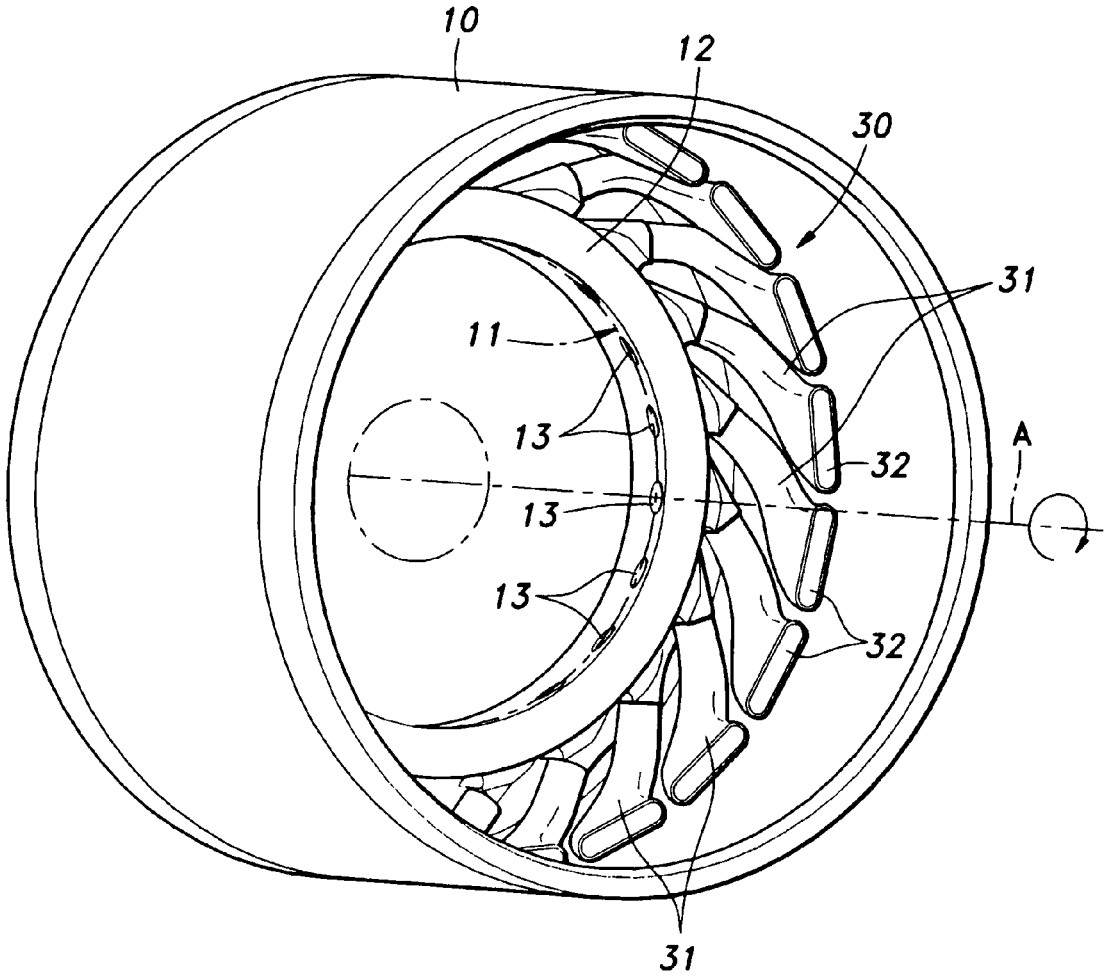
FIG. 1 is a perspective view of an axial diffuser for a centrifugal compressor embodying the present invention.
Figure 2:
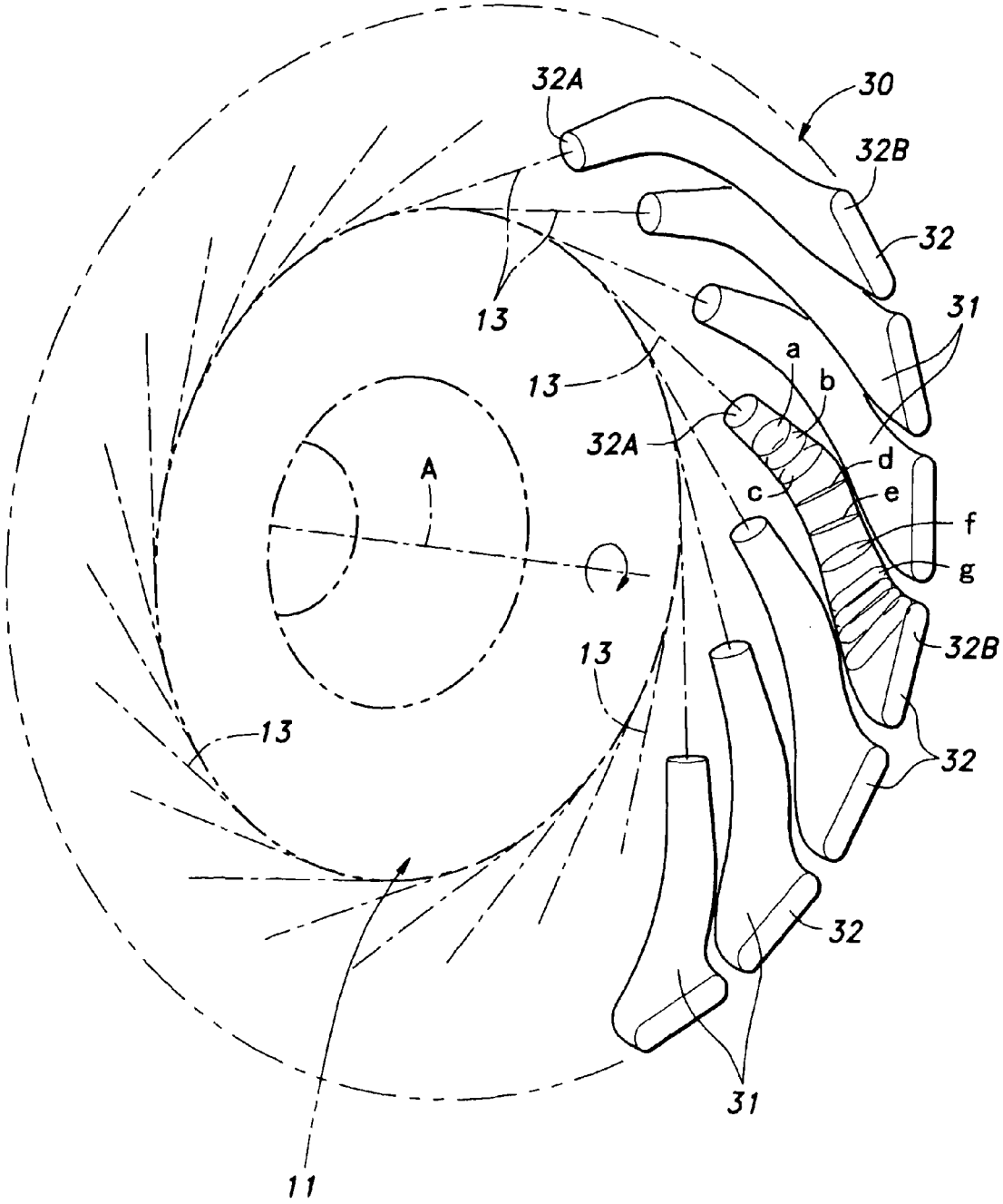
FIG. 2 is a perspective view showing the diffuser tubes of the axial diffuser.
Figure 3:
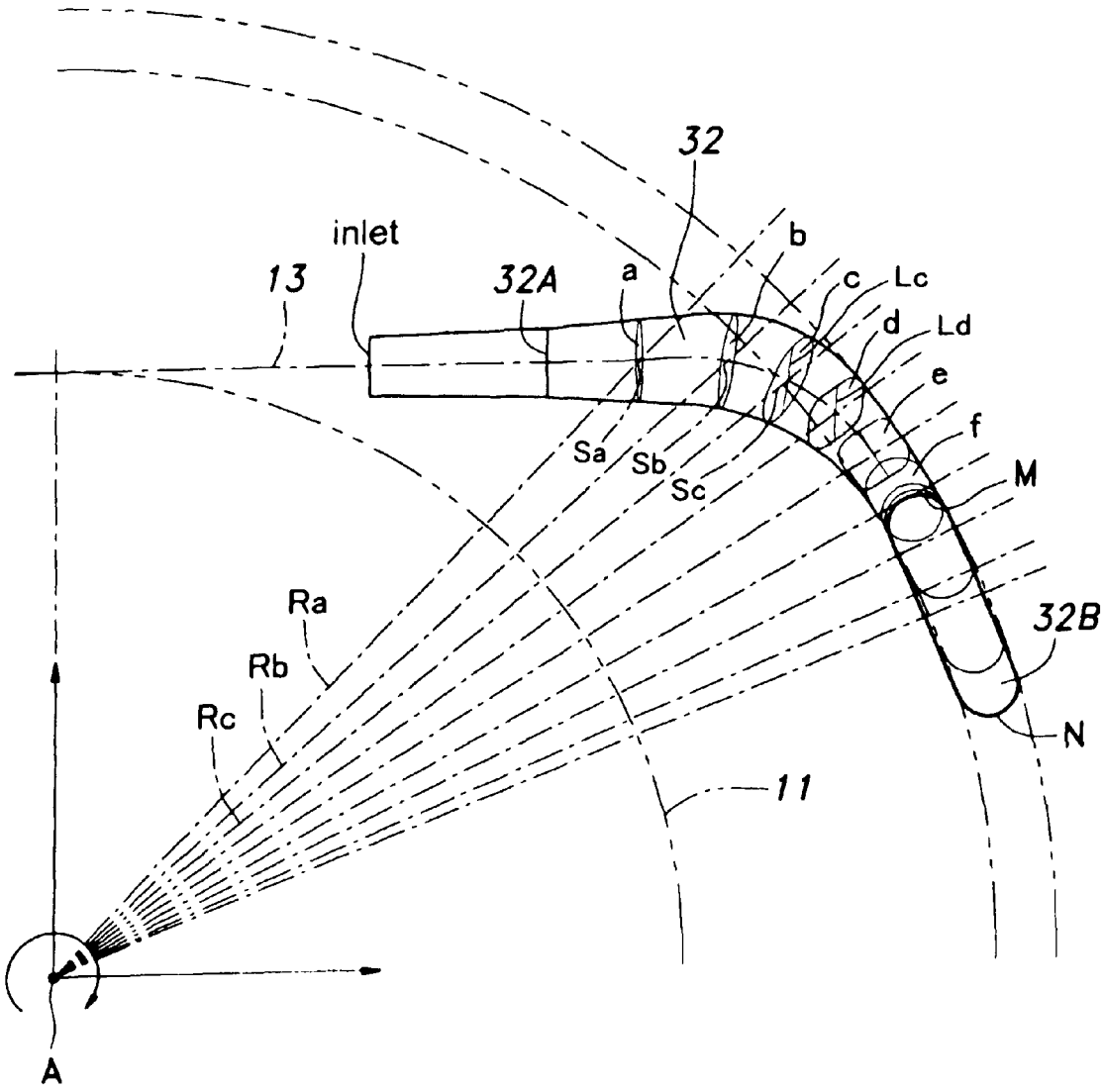
FIG. 3 is a diagram showing the configuration of each diffuser tube.

Inside a cylindrical outer housing 10 of a centrifugal compressor, an impeller 11 is supported so as to be rotatable around a central axial line A thereof. In FIGS. 1 to 3, the centrifugal compressor is viewed from the rear side thereof (downstream side with respect to the compressed air), and the impeller 10 rotates in clockwise direction, and only the outer periphery of the impeller 11 is indicated by a dotted line in FIG. 1.

An annular radial diffuser member 12 is fixedly attached to the outer housing 10 so as to concentrically surround the impeller 11, and is formed with a plurality of radial diffuser passages 13 arranged at a regular circumferential interval. Each radial diffuser passage 13 extends linearly in a tangential direction, and has a cross sectional area that progressively increases toward the downstream end thereof.

Each of the radial diffuser passages 13 formed in the radial diffuser member 12 reduces the velocity of the radial flow of the fluid (compressed air), and converts the kinetic energy of the fluid to pressure energy.

For further details of the radial diffuser, reference should be made to U.S. Pat. No. 6,280,139, for instance. The radial diffuser member 12 of the illustrated embodiment may be similar to that disclosed in Japanese patent laid open publication No. 2002-98093.

Radially around the radial diffuser member 12 is provided an axial diffuser 30 that includes a plurality of diffuser tubes 31 fixedly attached the outer circumferential surface of the radial diffuser member 12. The diffuser tubes 31 are the same in number as the radial diffuser passages 13 of the radial diffuser member 12, and the base end (upstream end) of each diffuser tube 31 is connected to the downstream end of the corresponding radial diffuser passage 13 by welding, for instance. Each diffuser tube 31 defines an axial diffuser passage 32. In other words, the axial diffuser passages 32 are formed by the individual tube members.

The upstream end of each axial diffuser passage 32 is directed in the tangential direction of the outer circumference of the impeller 11 so as to be smoothly connected to the corresponding radial diffuser passage 13.

More specifically, the axial diffuser 30 comprises a plurality of axial diffuser passages 32 arranged radially outwardly of the radial diffuser member 12 at a regular circumferential interval. Each axial diffuser passage 32 is given with a three dimensionally curved shape, and directs the radial flow of the fluid (compressed air) from the impeller 11 into an axial flow extending substantially in parallel with the central axial line A of the impeller 12, converting the kinetic energy of the fluid flowing into the axial diffuser passage 32 into pressure energy at the same time.

Each diffuser tube 31 consists of a curved tube member which has an upstream end 32A directed in the tangential direction of the circumference of the impeller 11 and an downstream end 32B directed in parallel with the central axial line A of the impeller 11.

The cross section of each axial diffuser passage 32 is given with an elliptic shape, track shape or other shape elongated in a prescribed diametral direction, and progressively increases in the cross sectional area and becomes more elongated toward the downstream end thereof as indicated by letters a, b, c, . . . . Thus, the cross section of each axial diffuser passage 32 has a major axis and a minor axis which are typically perpendicular to each other but may also be at a different angle relative to each other. In the illustrated embodiment, over the entire length of each axial diffuser passage 32, or from the upstream end 32A to the downstream end 32B, the major axis La, Lb, Lc, . . . at points a, b, c, . . . is substantially perpendicular to the radial line Ra, Rb, Rc, . . . which extends from the center of the cross section of the diffuser passage 32 to the impeller central axial line A. The impeller radial line is given as a line substantially perpendicular to the axial center line A in a downstream part of the diffuser passage 32 and a line at an angle different from 90 degrees to the axial center line A in an upstream part of the diffuser passage 32. In the illustrated embodiment, because the major axis and minor axis are perpendicular to each other, in each cross section of the axial diffuser passage 32, the minor axis indicated by Sa, Sb, Sc, . . . at different points along the length of the axial diffuser passage 32 coincides with the impeller radial line passing through the corresponding point in each case.

Typically, the minor axis and major axis are perpendicular to each other, but may also at an angle other than 90 degrees. In particular, if the cross section is given with a special or irregular form other than elliptic or track shape, the major axis may be defined as the longest diametral line.

By thus directing the major axis La, Lb, Lc, . . . of the cross section (which is typically elliptic or track shaped) substantially perpendicular to the radial line that extends from the center of the cross section to the central axial line A or the minor axis Sa, Sb, Sc, . . . of the cross section of each axial diffuser passage 32 to coincide with the central axial line A of the impeller 11 substantially at each and every point along the length of the axial diffuser passage 32, the negative pressure side and positive pressure side of the cross section of the axial diffuser passage 32 are at a same distance from the impeller axial center line A at each point along the length of the axial diffuser passage 32.

Thereby, the pressure unevenness or pressure gradient in the cross section owing the centrifugal component is minimized, and an unevenness in the flow of the compressed air or an unevenness in the distribution of the flow of the compressed air in the diffuser passage 32 can be significantly reduced at the downstream end 32B of the axial diffuser passage 32. In particular, an area of a low fluid velocity is prevented from being generated in the negative pressure side of the diffuser downstream end 32B. As a result, a high static pressure recovery ratio Cp can be achieved, and the efficiency of the centrifugal compressor can be improved. Furthermore, as the pressure gradient owing to the centrifugal force in each cross section of the axial diffuser passage 32 can be reduced, flow separation which tends to be produced in the negative pressure side can be effectively prevented.

Figure 4:
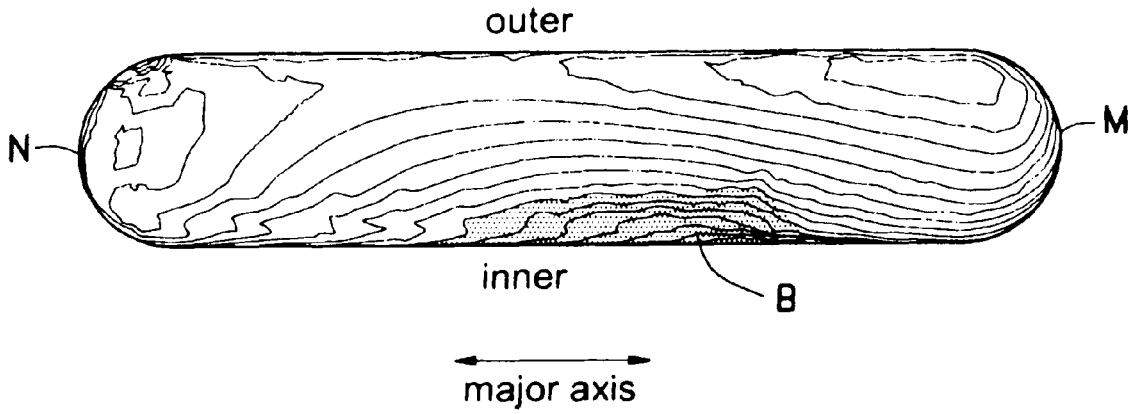
FIG. 4 is a contour map showing the Mach number distribution at the outlet end of the axial diffuser tube according to the present invention.
Figure 5:
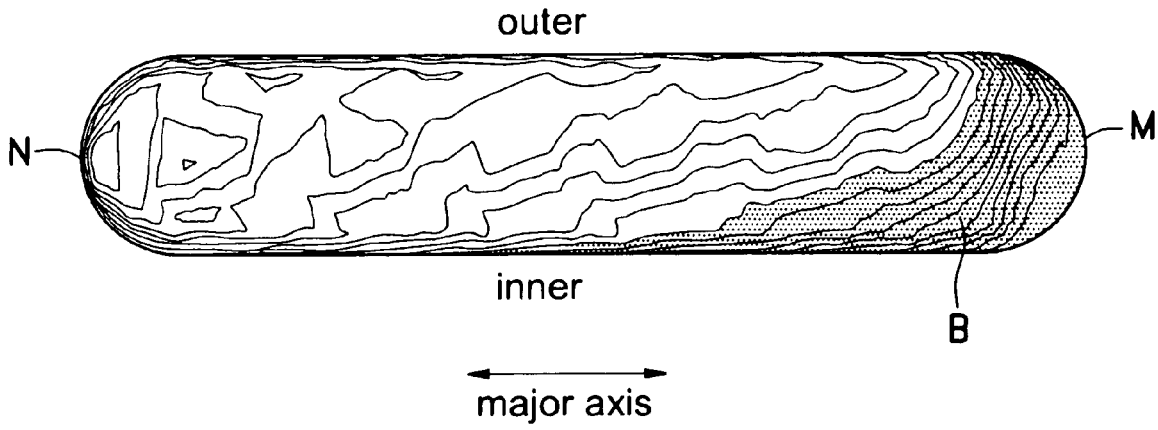
FIG. 5 is a contour map showing the Mach number distribution at the outlet end of a conventional axial diffuser tube.
Figure 6:
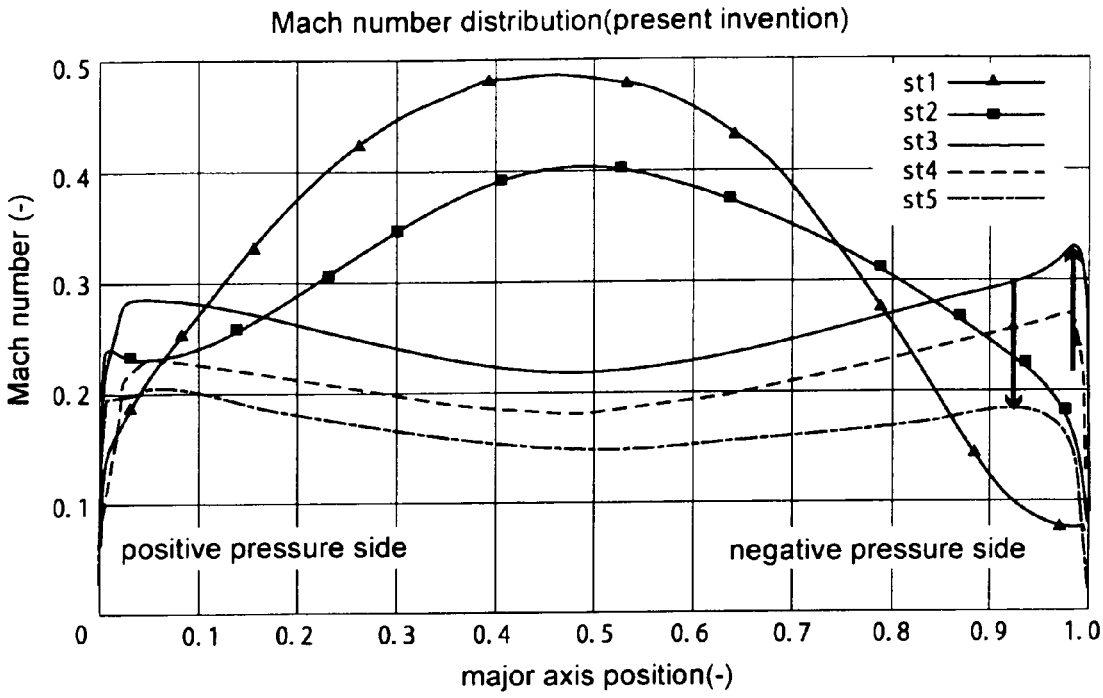
FIG. 6 is a graph showing the Mach number distribution along the major axis at each of a number of points along the length of each axial diffuser passage according to the present invention.

FIG. 4 shows the distribution of the Mach number in the diffuser downstream end of the axial diffuser of the illustrated embodiment, and FIG. 5 shows the same of the conventional axial diffuser. FIG. 6 is a graph showing the distribution of the Mach number along the major axis at various points along the length of the axial diffuser of the illustrated embodiment, and FIG. 7 is a graph showing the distribution of the Mach number along the major axis at various points along the length of the conventional axial diffuser.

In FIG. 5 (conventional diffuser), the shaded area B indicates the area of low fluid velocity which is believed to be caused by the centrifugal force (inertia force) that acts upon the fluid flowing through a bend of the axial diffuser passage. Owing to the centrifugal force, the fluid flow at the bend is biased toward the positive pressure side N, and this causes a reduction in the fluid velocity in the negative pressure side M. When the centrifugal force is significant, the fluid flow may separate from the wall surface of the negative pressure side. The movement of the low momentum flow in the boundary layer of the positive pressure side N to the negative pressure side M may also be a cause of the uneven distribution of the fluid velocity.

On the other hand, in the illustrated embodiment (FIG. 4), because the pressure gradient along the major axis of the cross section of the axial diffuser passage is minimized, a region where the fluid velocity is significantly reduced is not generated in the negative pressure side M of the axial diffuser passage. Ideally, the distribution of the Mach number should be even over the entire area of the cross section including the positive pressure side N and negative pressure side M. However, because of the balancing of pressure, the low momentum flow in the boundary layer tends to be collected in the central part of the diffuser passage at the downstream end thereof, a region of a relatively low fluid flow velocity tends to be generated in the central region between the positive pressure side N and negative pressure side M.

Figure 7:
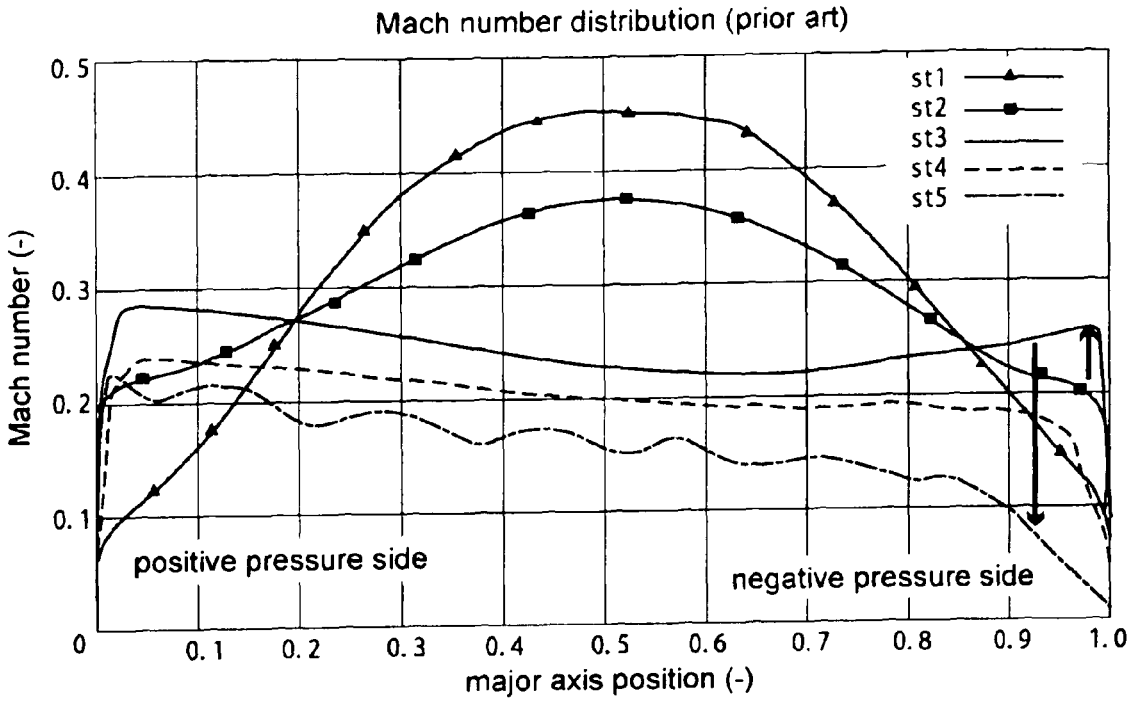
FIG. 7 is a graph showing the Mach number distribution along the major axis at each of a number of points along the length of each axial diffuser passage according to a conventional axial diffuser.
Figure 8:
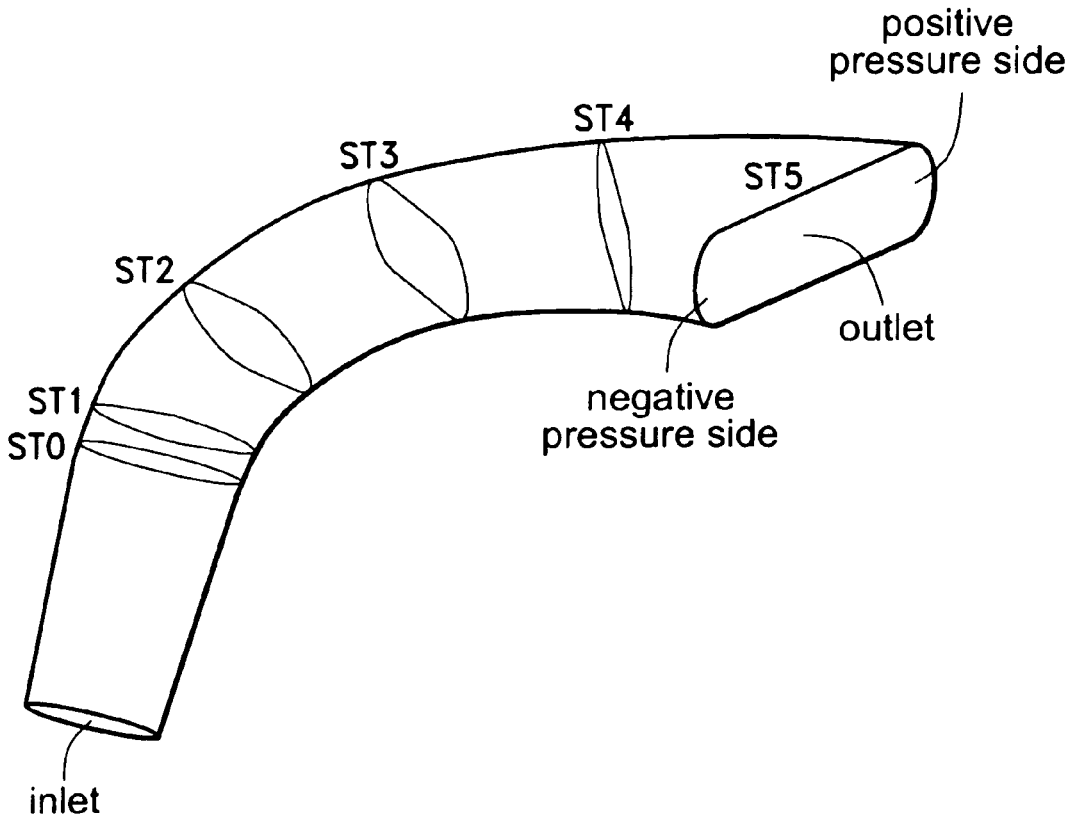
FIG. 8 is a perspective view of one of the diffuser tube members showing the various points along the length thereof.

FIG. 6 shows the Mach number distribution along the major axis at each of a number of points along the length of each axial diffuser passage according to the present invention, and FIG. 7 shows the same in the conventional axial diffuser. As shown in FIG. 8, various points along the length of the diffuser passage 32 are denoted with st0, st1, st2, st3, st4 and st5 from the upstream end to the downstream end of the diffuser passage 32. The point denoted with st5 corresponds to the downstream end or outlet end of the diffuser passage. In the conventional axial diffuser (FIG. 7), the increase in the velocity on the negative pressure side at st3 is small, and the fluid velocity progressively diminishes along st4 and st5 or toward the downstream end, and there is a significant reduction in the fluid velocity at st5 or the outlet end. As a result, the Mach number is distributed unevenly along the major axis at point st5. On the other hand, in the axial diffuser of the illustrated embodiment (FIG. 6), there is a significant increase in the fluid velocity on the negative pressure side at point st3, and the fluid velocity on the negative pressure side at this point is higher than that on the positive pressure side. The fluid velocity then gradually diminishes as the fluid flow passes points st4 and st5. The fluid velocity on the negative pressure side at the downstream end (outlet end) is thus kept at a relatively high level so that the Mach number is substantially evenly distributed along the major axis, and a highly uniform fluid flow is achieved at the downstream end of the diffuser passage 32.

Figure 9:
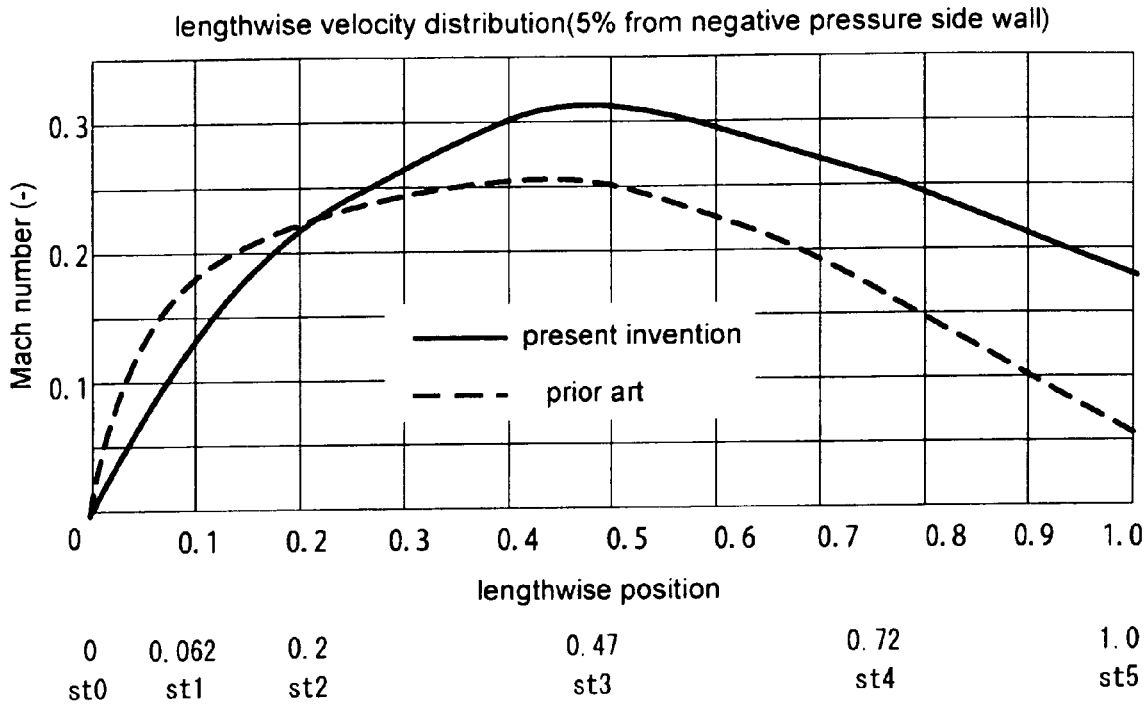
FIG. 9 is a graph showing the Mach number at a point 5% from the negative pressure side wall in relation to the position along the length of the diffuser passage for the present invention and prior art.

FIG. 9 shows the Mach number at a point 5% from the negative pressure side wall in relation to the position along the length of the diffuser passage using a solid line for the present invention and a dotted line for the prior art. In the graph of FIG. 9, the lengthwise position is indicated by a normalized value divided by the total length between st0 and st5 (see FIG. 8). In this case, the lengthwise position (non-dimensional value) is given as a distance (L) along a meridional line given as a trajectory of a center of each cross section divided by a diameter (D1) of an equivalent true circle having a same cross sectional area as the inlet position (FIG. 3) of the radial diffuser. In the prior art, the deceleration of the fluid flow becomes significant from point st3, and this tendency persists up to the downstream end. As a result, there is a significant drop in the fluid velocity at the downstream end. On the other hand, the fluid velocity at point st3 is somewhat higher than that of the prior art, and the fluid velocity progressively diminishes toward the downstream end as the fluid passes along points st4 and st5 but it occurs at a reduced rate as compared to the prior art. As a result, the drop in the fluid velocity at the downstream end is significantly controlled as compared to the prior art. Therefore, the fluid velocity on the negative pressure side at the downstream end can be kept at a significantly higher level than that of the prior art, and this produces the even distribution of the fluid velocity along the major axis as illustrated in FIG. 6 to be achieved.

Figure 10:
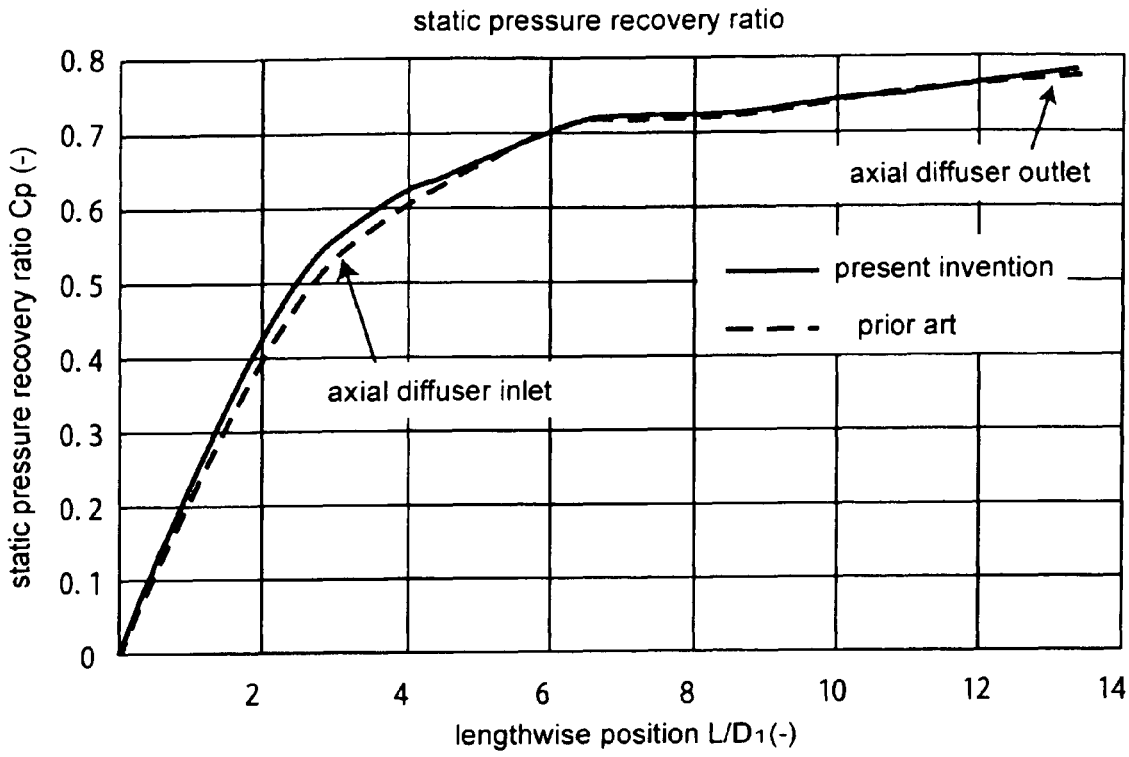
FIG. 10 is a graph showing the static pressure recovery ratio in relation to the position along the length of the diffuser passage for the present invention and prior art.

Owing to these factors, the illustrated embodiment allows a higher static pressure recovery ratio Cp to be achieved as compared to the prior art. FIG. 10 shows the change in the static pressure recovery ratio along the length of the diffuser passage in comparison with that of the prior art. The lengthwise position is defined similarly as in FIG. 9, but is not normalized in this case. It can be seen that the static pressure recovery ratio Cp of the illustrated embodiment at the downstream end or at the outlet end is somewhat higher than that of the prior art.

Although the present invention has been described in terms of preferred embodiments thereof, it is obvious to a person skilled in the art that various alterations and modifications are possible without departing from the scope of the present invention which is set forth in the appended claims.

The contents of the original Japanese patent applications on which the Paris Convention priority claim is made for the present application and the contents of any related prior art mentioned in the disclosure are incorporated in this application by reference.

The invention claimed is:

1. An axial diffuser for a centrifugal compressor, comprising a plurality of axial diffuser passages arranged around an impeller of the centrifugal compressor at a prescribed circumferential interval so that a radial fluid flow from the impeller is directed into an axial fluid flow substantially in parallel with a central axial line of the impeller, and kinetic energy of the fluid flow entering each diffuser passage is converted into pressure energy, wherein:

each axial diffuser passage includes an upstream end communicating with an outlet part of the impeller and a downstream end extending substantially in parallel with an axial line of the impeller, and defines a cross section progressively increasing in area from the upstream end to the downstream end thereof, the cross section of each axial diffuser passage being configured such that a relatively high velocity fluid flow in an upstream part of the diffuser passage is directed toward a negative pressure side of a cross section thereof.

2. The axial diffuser for a centrifugal compressor according to claim 1, wherein the cross section of each axial diffuser passage has a minor axis and a major axis, and the minor axis extends substantially perpendicularly to a direction directed from a center of the cross section to the central axial line of the impeller.

3. The axial diffuser for a centrifugal compressor according to claim 1, wherein the minor axis and major axis extend substantially perpendicularly to each other, and the minor axis is directed toward the central axial line of the impeller.

4. The axial diffuser for a centrifugal compressor according to claim 1, wherein the cross section of each axial diffuser passage is substantially elliptic or track shaped.

5. The axial diffuser for a centrifugal compressor according to claim 1, wherein the upstream end of each axial diffuser passage extends tangentially from a peripheral part of the impeller.

6. The axial diffuser for a centrifugal compressor according to claim 1, wherein each axial diffuser passage is defined by an individual tube member.

* * * * *